US006059126A

United States Patent [19]

Miller

[11] Patent Number: 6,059,126

[45] Date of Patent: May 9, 2000

[54] STAND FOR HOLDING RECYCLING BAGS

[76] Inventor: Jerry E. Miller, 4959 Joey Rd. NE., Moses Lake, Wash. 98837

[21] Appl. No.: 09/275,007

[22] Filed: Mar. 24, 1999

Related U.S. Application Data

[60] Provisional application No. 60/087,806, Jun. 3, 1998.

[51] Int. Cl.[7] ..... A47G 29/00; B65B 67/12

[52] U.S. Cl. ..... 211/85.15; 211/12; 248/95; 248/100

[58] Field of Search ..... 211/85.15, 12, 211/60.1, 70.1, 70.8, 193, 206, 72; 248/95–100; D6/491, 492, 495, 509

[56] References Cited

U.S. PATENT DOCUMENTS

| | | | |
|---|---|---|---|
| 30,671 | 11/1860 | Dodge | 108/8 |
| 1,380,570 | 6/1921 | Lehman | 211/60.1 |
| 1,698,974 | 1/1929 | Vance | 211/60.1 |
| 3,164,255 | 1/1965 | Jay | 211/60.1 |
| 3,512,654 | 5/1970 | Olsen et al. | 211/193 |
| 3,601,256 | 8/1971 | Bowers, Jr. et al. | 211/193 |
| 3,787,016 | 1/1974 | Laval, Jr. | 211/193 |
| 3,806,146 | 4/1974 | Shaw | 248/98 X |
| 3,905,406 | 9/1975 | Cruse . | |
| 4,065,089 | 12/1977 | Frazier et al. | 211/193 X |
| 4,396,125 | 8/1983 | Rowader | 211/193 |
| 4,403,703 | 9/1983 | Nikles, Jr. | 211/193 |
| 4,426,011 | 1/1984 | Jay | 211/193 |
| 4,444,323 | 4/1984 | Travis | 211/193 |
| 4,469,300 | 9/1984 | Valesko | 248/99 X |
| 4,723,743 | 2/1988 | Jenkins . | |
| 5,033,703 | 7/1991 | Allen, Sr. . | |
| 5,054,724 | 10/1991 | Hutcheson . | |
| 5,080,237 | 1/1992 | Hefner | 211/85.15 |
| 5,101,984 | 4/1992 | Shaw . | |
| 5,131,499 | 7/1992 | Hoar . | |
| 5,169,101 | 12/1992 | Wenzel et al. . | |
| 5,190,252 | 3/1993 | Schrager . | |
| 5,232,186 | 8/1993 | Corkery . | |
| 5,273,170 | 12/1993 | Azzopardi et al. | 211/189 |
| 5,464,102 | 11/1995 | LeBlanc et al. . | |
| 5,513,823 | 5/1996 | Bresnahan . | |
| 5,538,148 | 7/1996 | Indyk | 211/195 |
| 5,639,051 | 6/1997 | Surbeck . | |
| 5,772,046 | 6/1998 | Tercher et al. | 211/12 |
| 5,894,946 | 4/1999 | Darnell et al. | 211/193 |

*Primary Examiner*—Daniel P. Stodola
*Assistant Examiner*—Jennifer E. Novosad
*Attorney, Agent, or Firm*—Richard C. Litman

[57] ABSTRACT

An ergonomic household stand having a plurality of parallel upright posts on pedestals, a plurality of horizontal arms with ears, and crossbars between the posts for holding various container elements such as laundry bags, potted plant containers, and conventional plastic grocery store bags for separating recycling waste products such as plastic bottles, aluminum foil tin cans, newspapers, dead plants and the like. The economical stand can be made of medium density fiberboard or recycled plastic. The stands can hold from 3 to 12 plastic recycling bags or other container elements depending on the number of arms available in a specific structure.

14 Claims, 8 Drawing Sheets

STAND FOR HOLDING RECYCLING BAGS

CROSS-REFERENCE TO RELATED APPLICATION

This application claims the benefit of U.S. Provisional Patent Application Ser. No. 60/087,806, filed Jun. 3, 1998.

BACKGROUND OF THE INVENTION

1. Field of the Invention

The present invention relates to a household stand for holding conventional plastic grocery store bags, to facilitate the separation of recyclable waste products such as plastic bottles, aluminum foil, tin cans, newspapers, dead plants and the like. The economical stand can be made of medium density fiberboard or recycled plastic. The stands can hold 3 to 12 bags in different configurations and different floor bases.

2. Description of Related Art

The related art of interest describes various bag holding stands as varied in structure as folding, rotary, boxed, and ring-shaped. There is a need for a sturdy upright stand with coordinated arms for keeping the collection bags open for use for separate recyclable materials. The related art will be discussed in the order of perceived relevance to the present invention.

U.S. Pat. No. 5,232,186 issued on Aug. 3, 1993, to Richard Z. Corkery describes a multiple garbage bag holder frame adapted to fit inside a garbage container (blue box) or be free-standing. The bag holding elements are 12 H-shaped upright members positioned in two rows of 6 each on top of two parallel horizontal rods Which are connected to two U-shaped supports to form a square frame. Two other cross member rods complete the frame structure. Each garbage bag is strung from four H-shaped upright members with two sides of the bag on parallel pairs of upright members for a holding capacity of five recycling bags. This garbage bag holder is distingtuishable as a structure to fit inside a garbage container, and there is no disclosure of a free standing structure with extended feet as in the present invention.

U.S. Pat. No. 5,054,724 issued on Oct. 8, 1991, to Mabel C. Hutcheson describes an open box container for supporting a single limp plastic bag in an upright, four cornered configuration. Four embodiments of the holder portions comprise a pair of ears open at the corners (FIGS. 1, 4, 5, and 7) or only a pair of ears at each side (FIG. 6). The container can be made of either plastic, resin, wood or metal. The container is distinguishable because of its box structure.

U.S. Pat. No. 4,723,743 issued on Feb. 9, 1988, to Jeffrey C. Jenkins describes an open metal rod framed rack for holding open one either paper or plastic grocery bag. The front portion of the frame is partially open in the center. The rear portion has an extended subrack for storing folded bags. Each side portion has a bag holder portion consisting of two inverted U-shaped elements as part of a U-shaped larger structure. The rack is distinguishable for its box structure and limited bag captacity.

U.S. Pat. No. 5,101,984 issued on Apr. 7, 1992, to Lu Ann W. Shaw describes a recycling trash bag rack with parallel front and rear sides which are each made from four vertical pipes and three horizontal pipes joined at the top with elbows. Seven intermediate flat webs with a pair of upright ribs across the top join the front and rear side frames and hold the loops of the bags. Each bag has inclined lettering to identify the type of trash to be recycled. The rack is distinguishable for its singular row of bags.

U.S. Pat. No. 5,033,703 issued on Jul. 23, 1991, to Johnny G. Allen, Sr. describes cantilevered ring assemblies for supporting four refuse bags and staked in the ground, in one embodiment. Secondary inner rings hold the bags. Other modifications include hanging a bag on either a doorknob or a longitudinal fixture, or free standing on a circular frame. The ring assemblies are distinguishable for their different circular structure.

U.S. Pat. No. 5,464,102 issued on Nov. 7, 1995, to Wayne LeBlanc et al. describes a foldable cardboard apparatus for transporting up to six filled plastic grocery bags. Three posts are provided on top of the central upright portion for hanging the filled grocery bags. Two bottom flaps support the loaded bags. The cardboard apparatus is distinguishable for its T-shaped folding structure.

U.S. Pat. No. 5,131,499 issued on Jul. 21, 1992, to Bruce E. Hoar describes a rotary device delineated into circumferentially spaced compartments for successively storing plastic bags with handles hooks for a retail store checkout station. The device is distinguishable for its rotary compartmentalized design.

U.S. Pat. No. 5,190,252 issued on Mar. 2, 1993, to Lawrence A. Schrager describes a refuse bag support system for recycling materials. A first embodiment comprises a plastic tub with a series of metal arms with channel locking elements pivoting from an axial post to hold a plurality of bags. The post can be eliminated with flexible holding arms to nest empty bags and one open bag. Another embodiment utilizes a two-section box which can be expanded. Each pair of arms on top of the expandable box can be moved to adjust the opening of the bags. The bag holding devices are distinguishable for the different structures of the tub and box systems.

U.S. Pat. No. 3,905,406 issued on Sep. 16, 1975, to Brentwood A. Cruse describes a boxed wire support stand on four legs for supporting a plastic or paper flexible bag. The wire frame can be adjusted in size. The bag support stand is distinguishable for its single bag capacity.

U.S. Pat. No. 5,169,101 issued on Dec. 8, 1992, to Richard Wenzel et al. describes a boxed rack frame for collecting recyclable materials in an open bag and including an apertured cover with an upright message board. The boxed frame for a single bag is distinguishable from the multiple bag stand of the present invention.

U.S. Pat. No. 5,639,051 issued on Jun. 17, 1997, to Donald Surbeck describes a trash bag holding device comprising a 5° canted base with two hooks for hanging a plastic grocery bag with looped handles on a cabinet door. The device is distinguishable for its singular bracket.

U.S. Pat. No. 5,513,823 issued on May 7, 1996, to Jeremiah J. Bresnahan describes a plastic bag holder for bags with integral loop handles. An elongated mounting panel supports inverted U-shaped pivotable planar arms at end in mounting ears. An arm is formed with two bights for supporting a loop of the plastic bag. The bag holder is distinguishable for its wall mounting and two pivotable arms.

None of the above inventions and patents, taken either singly or in combination, is seen to describe the present invention as claimed.

SUMMARY OF THE INVENTION

The invention is a series of ergonomic household stands for holding various container elements such as laundry bags, potted plant bags, and conventional plastic grocery store bags. This makes it easy to separate recycling waste products such as plastic bottles, aluminum foil, tin cans, newspapers, dead plants and the like into appropriate bags. The stand can be made of medium density fiberboard or recycled plastic. The stands include various arms so that a stand can hold from 3 to 12 plastic recycling bags or the like, depending on the number of arms available in a specific structure.

Accordingly, it is a principal object of the invention to provide an economical stand for holding a plurality of recycling bags for separate recyclable materials.

It is another object of the invention to provide an economical stand for holding recycling bags, the stand being made from either medium density fiberboard or recycled plastic material.

It is a further object of the invention to provide an economical stand for holding recycling bags on both sides of parallel posts.

Still another object of the invention is to provide an economical stand for holding recycling bags on one side of parallel posts.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a series of economical stands for supporting a plurality of recycling bags on a rack. There is a need for a simple rack stand usable in either a home or a multiple dwelling building for the sorting of recycling materials such as metal cans, newspapers, plastic bottles, aluminum foil, and the like.

Figure 1:
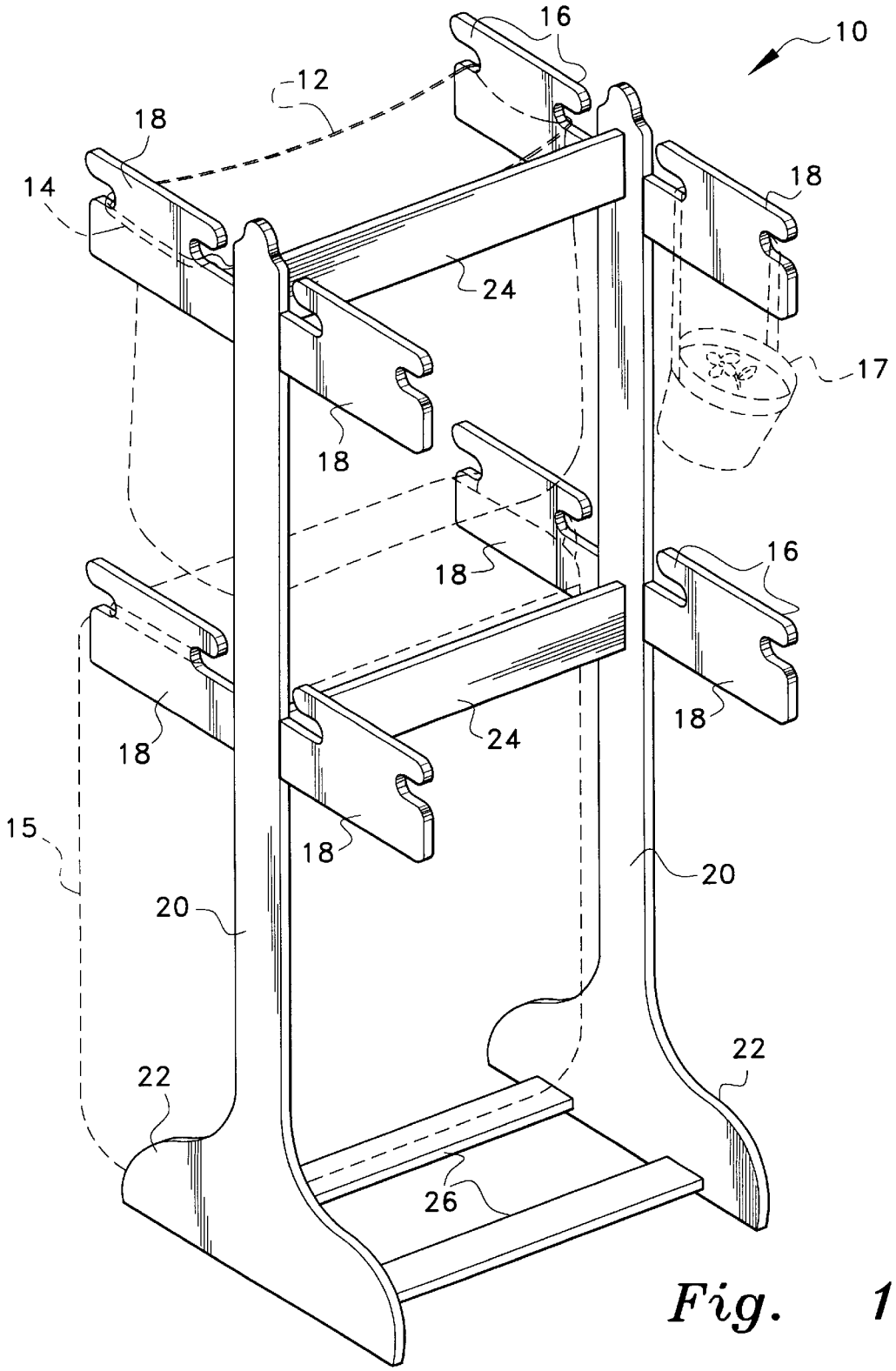
FIG. 1 is an environmental, perspective view of a first embodiment of a stand for holding up to four recycling bags with one bag, a laundry bag and a flower pot shown in shadow according to the present invention.
Figure 2:
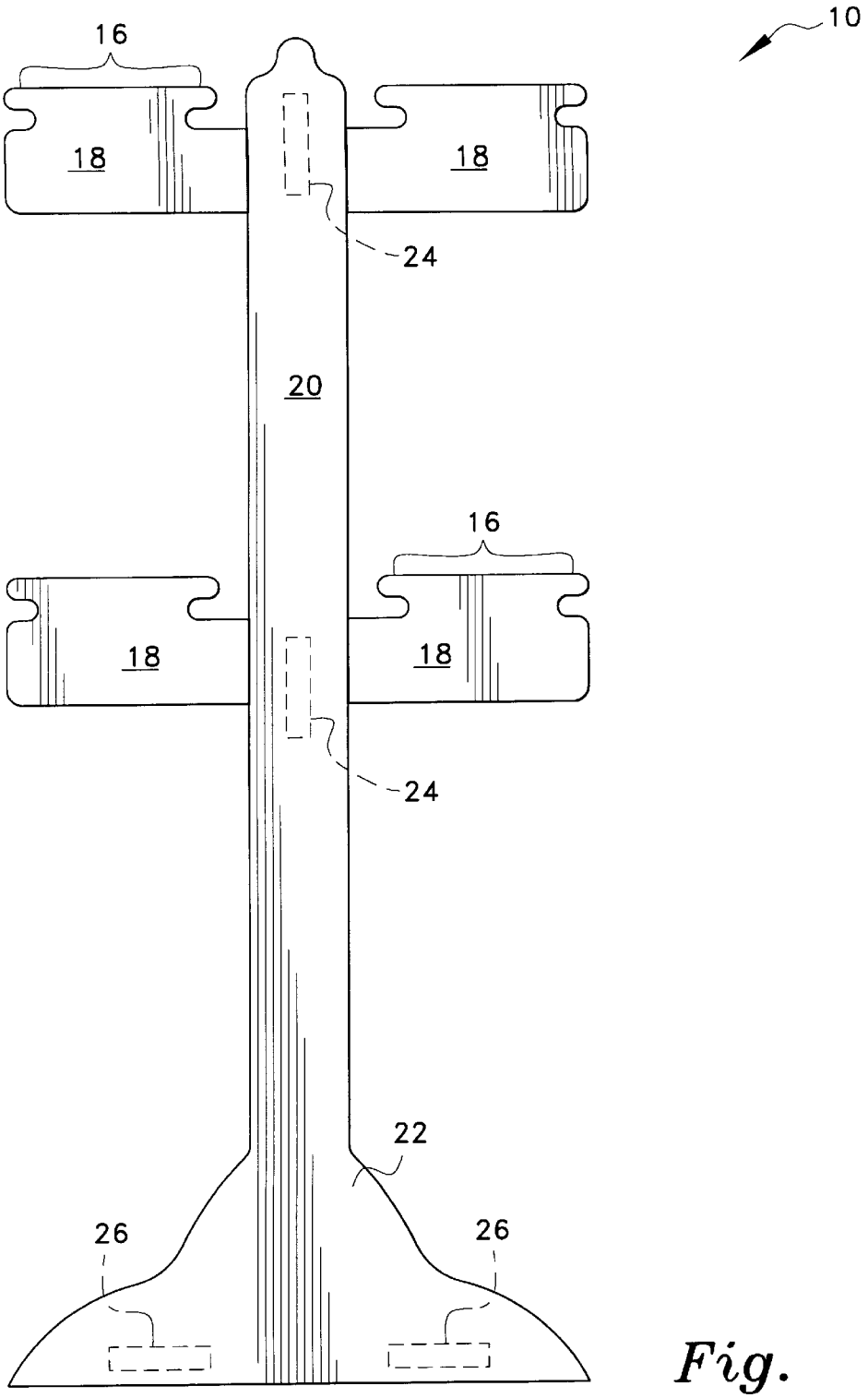
FIG. 2 is a side elevational view of the FIG. 1 stand.
Figure 3:
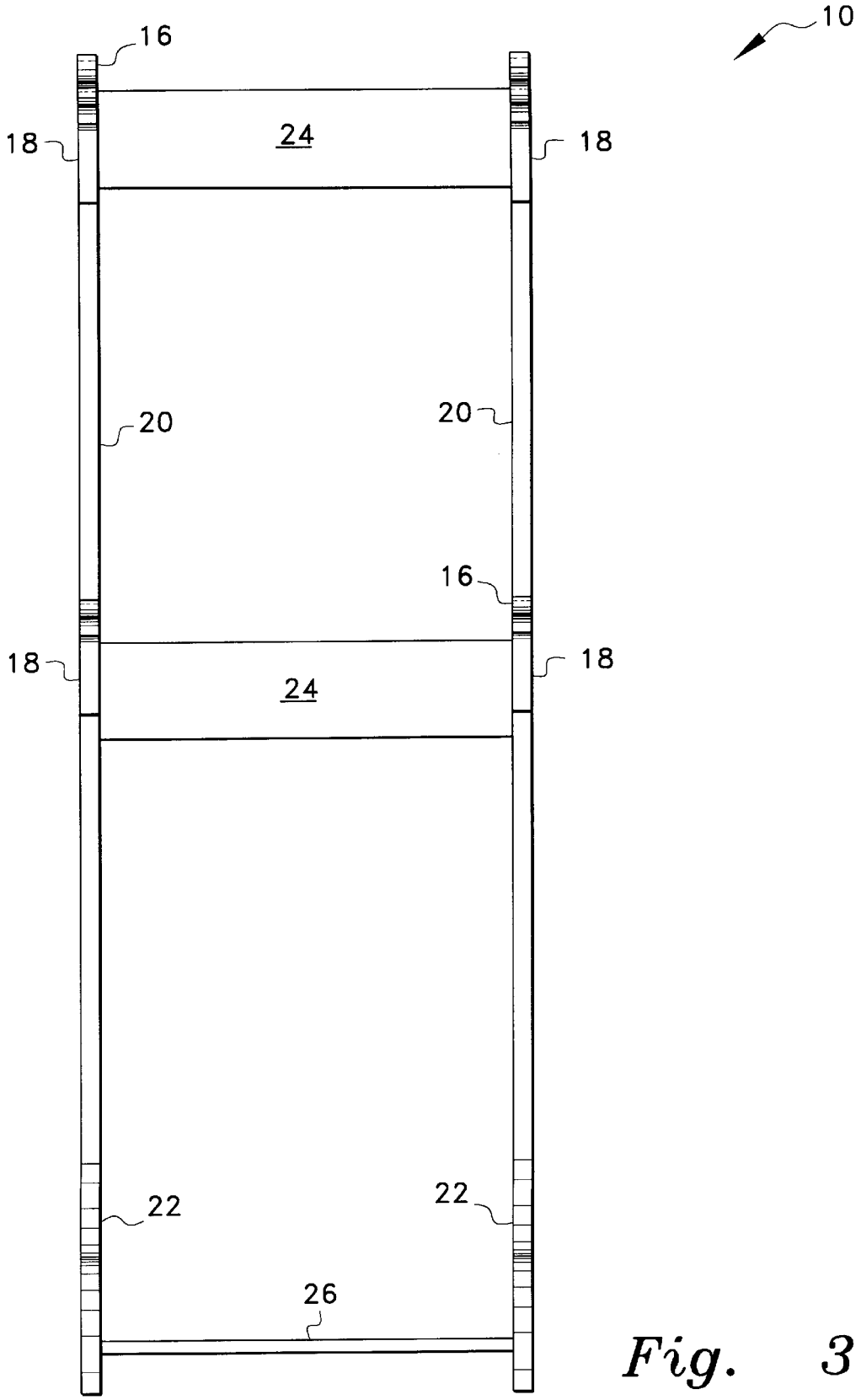
FIG. 3 is a front elevational view of the FIG. 1 stand.
Figure 4:
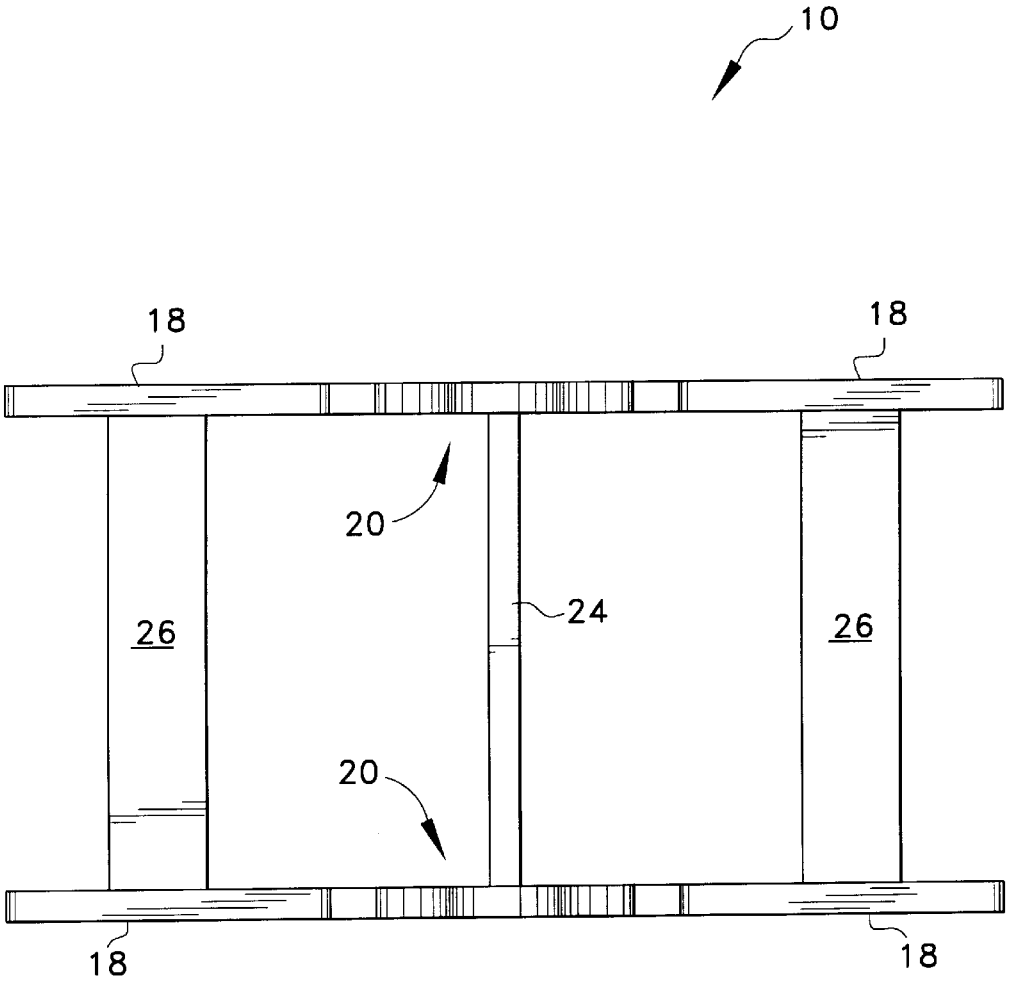
FIG. 4 is a top plan view of the FIG. 1 stand.

In the first embodiment shown in FIGS. 1–4, an economical rack stand 10 is shown for hanging at least four recycling bags with one exemplary plastic grocery bag 12 shown in shadow with its loops 14 draped around the ears 16 of forwardly and rearwardly extending arms 18. In FIG. 1, a garment bag 15 and a flower pot 17 are depicted in shadow to show that a mixture of container elements can be hung on the stand. Arms 18 extend from two parallel upright flat posts 20 on pedestals 22. A pair of flat horizontal crossbars 24 are located between the posts 20. A pair of horizontal flat crossbars 26 are positioned between the pedestals 22 and contacting the floor. The stand 10 can be fabricated from readily available stock materials such as medium density fiberboard and recycled plastic. The method of joining the parts can be dadoing or mortising with tenons (not shown).

Figure 5:
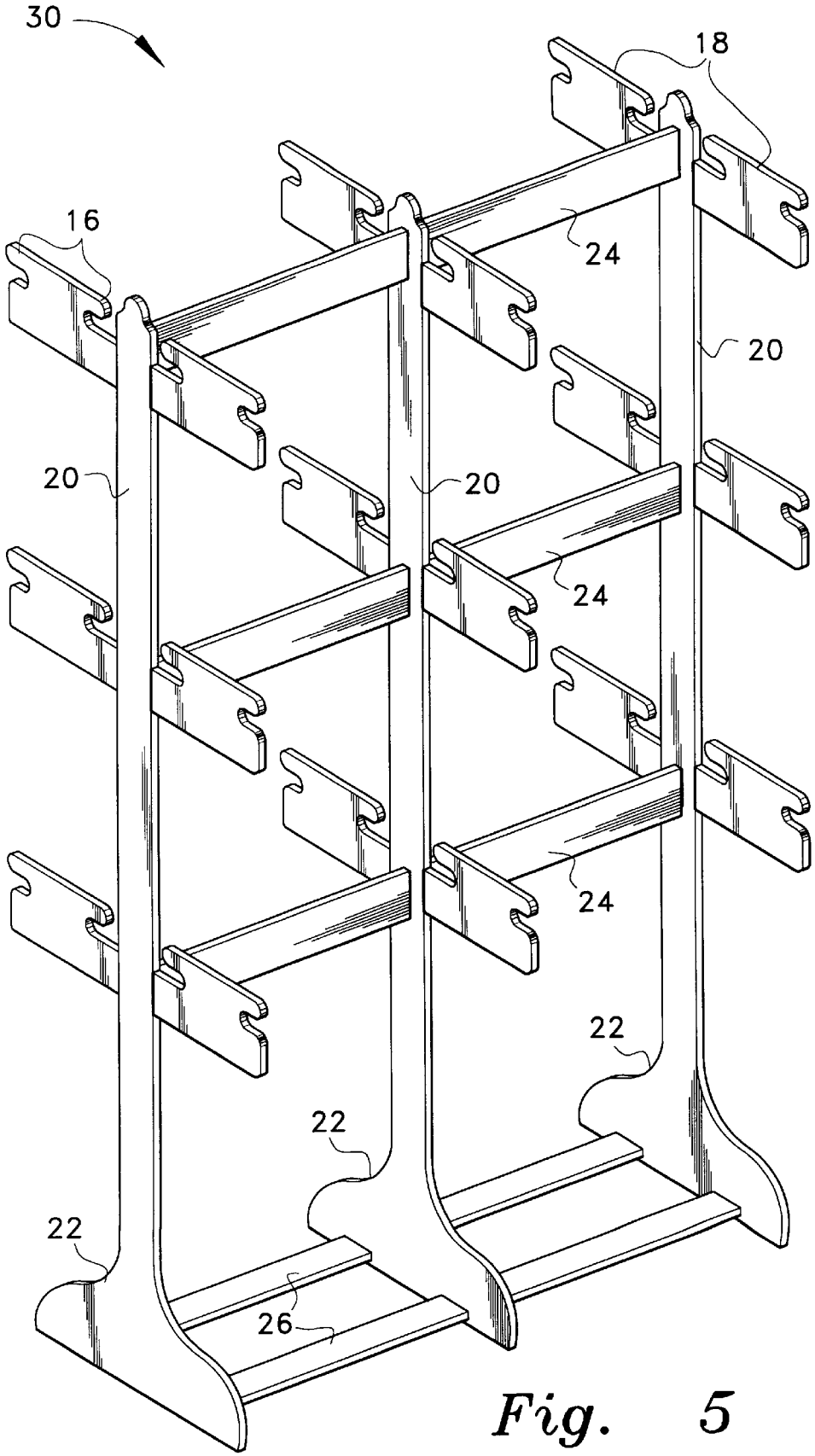
FIG. 5 is a perspective view of a second embodiment of a stand for holding up to twelve recycling bags.

In FIG. 5, a second embodiment of an 18 arm, 12 bag capacity stand 30 is illustrated. The configurations of the arms 18, posts 20, post pedestals 22, and crossbars 24 and 26 are similar to those in the first embodiment. The large capacity of bags may be regarded as superfluous for a small household, but for a multiple dwelling building it would be advisable. The individual bags can be labelled to inform the users to separate their recycling materials according to the identified bag. Further, it would be advisable to identify the lowermost arms for heavy recycling materials such as newspapers, cans, and glass bottles. Lightweight items such as plastic bottles, dead plants/foliage and aluminum foil can be relegated to the upper arms.

Figure 6:
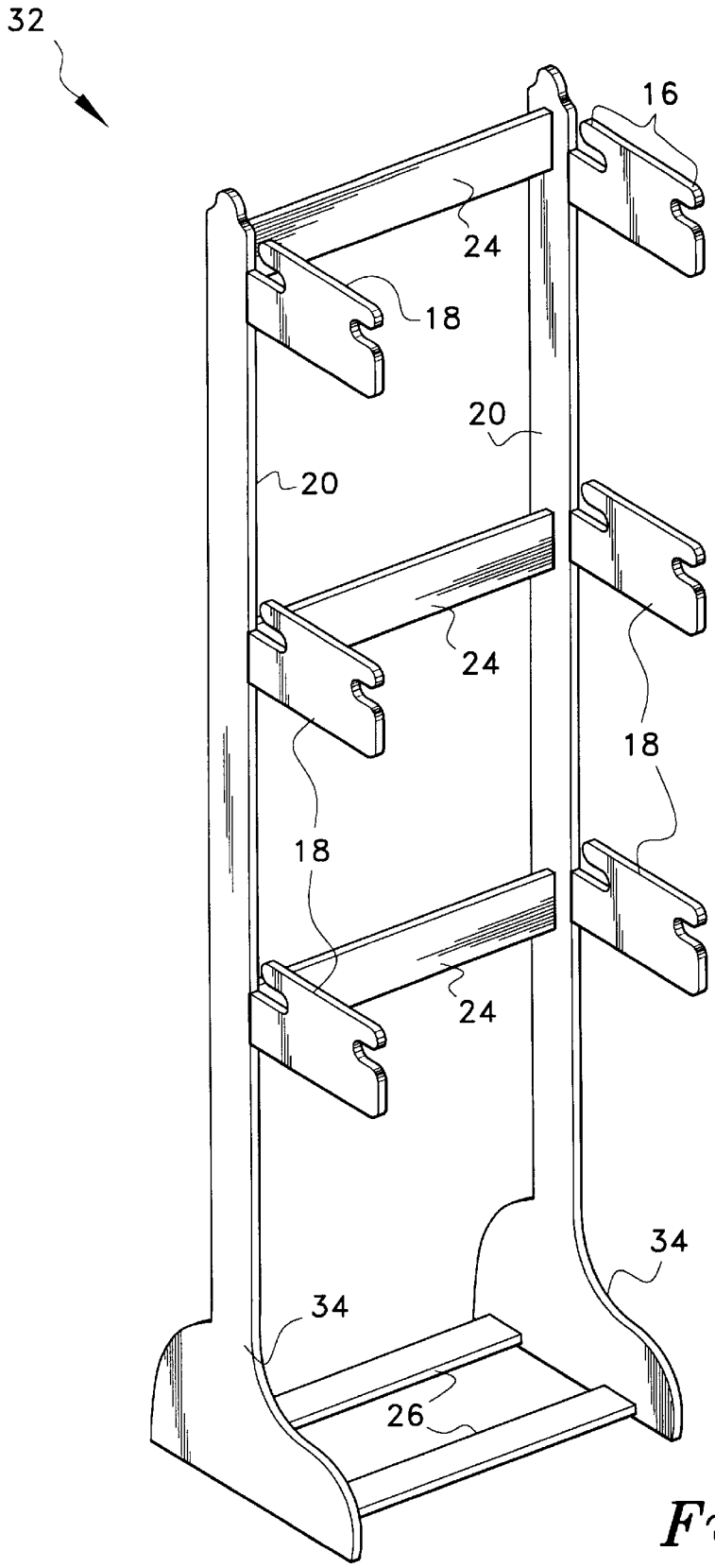
FIG. 6 is a perspective view of a third embodiment of a stand for holding up to three recycling bags.

In FIG. 6, a third embodiment of a two-post, 6 arm, 3 bag capacity recycling rack stand 32 is shown. The significant differences are the positioning of the arms 18 only on one side or the front and the shoe-shaped pedestals 34 of the posts 20. This structure affords easier access to the open bags (not shown) and provides a counter-balance with the extended pedestals 34.

It should be noted that the ears 16 of the arms 18 can be utilized to support extra empty bags which can replace full bags to be hung on the outside regions of the arms 18. This advantage is possible due to the structure of the eared arms 18. This feature can be accommodated by the rack stands of the other embodiments.

Figure 7:
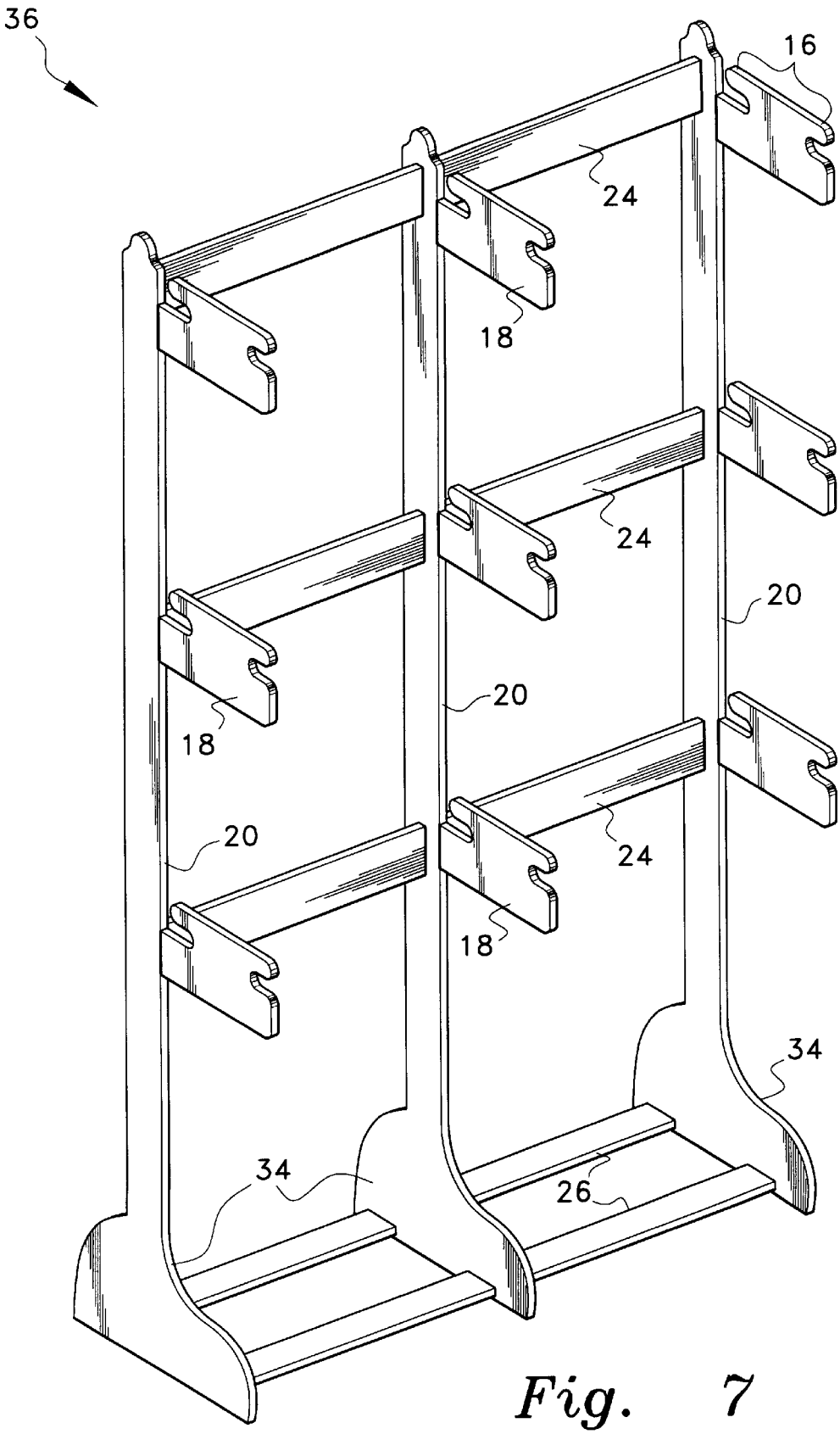
FIG. 7 is a perspective view of a fourth embodiment of a stand for holding up to six recycling bags.

In FIG. 7, a fourth embodiment of a rack stand 36 with 9 arms 18 only in front, 3 posts 20 and shoe-shaped pedestals 34 is depicted. The rack stand 36 is a doubled modification of the FIG. 6 embodiment.

In a final fifth embodiment of a rack stand 38 illustrated in FIG. 8, each arm 40 has been enlarged to have an integrated triangular portion 42 extending below to increase the strength of the arms 40 for heavy duty such as metal cans or large glass jars. The preferred material for this embodiment is plastic. In other respects, this rack stand 38 has similar dimensions as the rack stand 10 in FIGS. 1–4.

Exemplary dimensions of the rack stands of FIGS. 1–8 made from 0.75 in. thick stock material are as follows:

FIGS. 1–4: 2 post stand; 4 bag capacity; post 45.75 in. high; overall 16 in. deep and 13 in. wide; 8 arms, 4 in. height; top level arms, 45 in. high, bottom level arms, 25 in. high; crossbars 3 in. wide; and bottom crossbars 0.75 in. above floor level.

FIG. 5: 3 post stand; 12 bag capacity; 25.25 in. wide; 18 arms; top level arms, 65 in. high; mid level arms 45 in. high; and bottom level arms 25 in. high.

FIG. 6: 2 post stand with pedestals shaped like shoes; 3 bag capacity; 6 arms only in front; 65 in. high; 13 in. wide; 12 in. deep; and arm heights as in FIG. 5.

FIG. 7: 3 post stand with pedestals shaped like shoes: 6 bag capacity; 9 arms only in front; and remaining dimensions similar to the FIG. 6 stand except for a 25.25 in. width.

Figure 8:
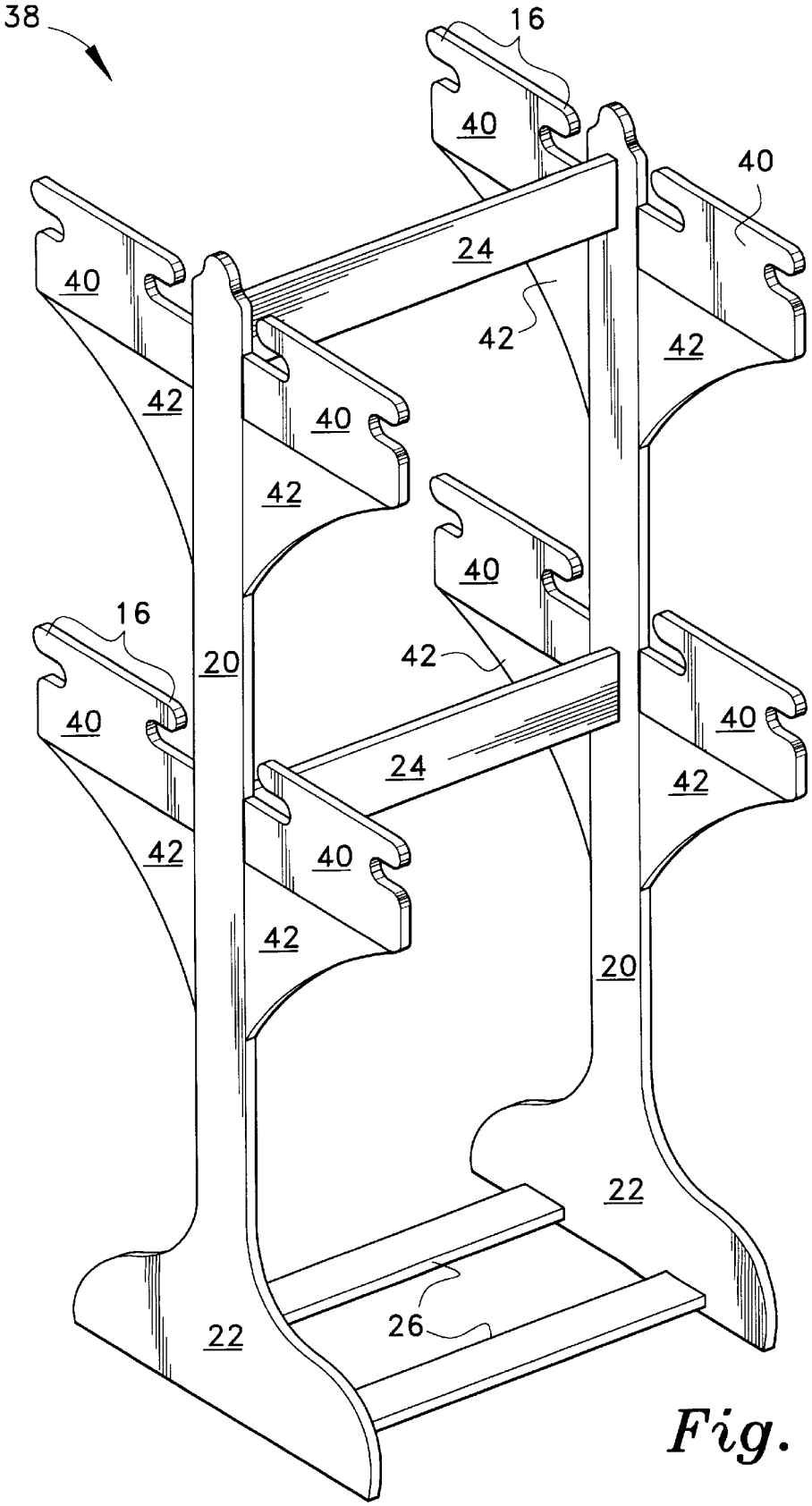
FIG. 8 is a perspective view of a fifth embodiment of a stand for holding up to eight recycling bags with additional supports for each bag holding arm.

FIG. 8: 2 post stand with pedestals: 4 bag capacity; 8 arms with each having an integrated triangular support 8.5 in. high and 7 in. wide; and remaining dimensions similar to the first embodiment stand.

Thus, ergonomic rack stands of varying capacities and structures for holding container elements or recycling bags have been presented for use in either single dwellings or larger multiple dwelling buildings. Separation of the recycling materials for disposal is enhanced and minimizes aimless dumping. These rack stands are now a necessary adjunct device in the saving of valuable man-made materials as recognized in this country.

Of course, the ergonomic invention may be adapted to other uses. For example, any of the stands could be used as a laundry rack, for children or adults, to name just one alternate use. For another, the stands can be employed for hanging plants therefrom. Other uses suggest themselves, in any environment where it is desirable to hang or suspend items or articles in an array, organized or not.

It is to be understood that the present invention is not limited to the embodiments described above, but encompasses any and all embodiments within the scope of the following claims.

I claim:

1. An ergonomic rack stand for hanging a plurality of container elements comprising:

at least two parallel upright flat posts on pedestals;

a plurality of horizontal flat crossbars positioned between the pedestals and proximate to a floor;

a plurality of flat horizontal crossbars located between the posts;

a plurality of horizontal arms, wherein each arm being rectangular in shape with a pair of ears on top for holding a container element; and the arms extending from each post in one of a forward position and a forward-rearward position, whereby a plurality of container elements can be hung from the ears on the stand in an array.

2. The rack stand according to claim 1, including a triangular portion integrated below said rectangular shape of each of the arms.

3. The rack stand according to claim 1, including a flat crossbar positioned between each post at a region of each arm.

4. The rack stand according to claim 1, wherein the plurality of arms are positioned in only forward positions on the posts.

5. The rack stand according to claim 4, wherein said pedestals are shaped like shoes with toe portions facing in a forward direction same as the arms.

6. The rack stand according to claim 5, including three arms on each of two posts.

7. The rack stand according to claim 5, including three arms on each of three posts.

8. The rack stand according to claim 1, wherein the arms extend from the posts in both forward and rearward positions.

9. The rack stand according to claim 8, including four arms on each of two posts.

10. The rack stand according to claim 8, including six arms on each of three posts.

11. An ergonomic rack stand and a plurality of hanging container elements comprising:

at least two parallel upright flat posts on pedestals;

a plurality of horizontal flat crossbars Positioned between the pedestals and proximate to a floor;

a plurality of flat horizontal crossbars located between the posts;

a plurality of horizontal arms, wherein each arm being rectangular in shape with a pair of ears on top for holding a container element;

the arms extending from each post in one of a forward position and a forward-rearward position; and a plurality of container elements hung from the ears on the rack stand selected from the group consisting of plastic bags, laundry bags, potted plant containers, and combinations thereof.

12. The rack stand according to claim 11, wherein the plurality of container elements are plastic bags with loop handles.

13. The rack stand according to claim 11, wherein the plurality of container elements are laundry bags.

14. The rack stand according to claim 11, wherein the plurality of container elements are potted plant containers.

* * * * *